US011351567B2

(12) United States Patent
Pentland

(10) Patent No.: US 11,351,567 B2
(45) Date of Patent: Jun. 7, 2022

(54) APPLICATOR WITH INTERCHANGEABLE HEADS

(71) Applicant: Ingersoll Products Inc., Ingersoll (CA)

(72) Inventor: James Pentland, London (CA)

(73) Assignee: INGERSOLL PRODUCTS INC.

( * ) Notice: Subject to any disclaimer, the term of this patent is extended or adjusted under 35 U.S.C. 154(b) by 0 days.

(21) Appl. No.: 17/271,444

(22) PCT Filed: Aug. 27, 2019

(86) PCT No.: PCT/CA2019/051175

§ 371 (c)(1),
(2) Date: Feb. 25, 2021

(87) PCT Pub. No.: WO2020/041868

PCT Pub. Date: Mar. 5, 2020

(65) Prior Publication Data

US 2021/0323023 A1 Oct. 21, 2021

Related U.S. Application Data

(60) Provisional application No. 62/724,304, filed on Aug. 29, 2018.

(51) Int. Cl.
*B05C 17/005* (2006.01)
*B05C 11/04* (2006.01)
(Continued)

(52) U.S. Cl.
CPC ..... *B05C 17/00516* (2013.01); *B05C 11/044* (2013.01); *B05C 11/045* (2013.01);
(Continued)

(58) Field of Classification Search
CPC ..... B05C 17/00516; B05C 17/00586; B05C 11/044; B05C 11/045; B65D 47/42; E04F 21/165–1655
See application file for complete search history.

(56) References Cited

U.S. PATENT DOCUMENTS 1,348,639 A * 8/1920 Grundmann ..... E04F 21/1652 15/235.3
2,772,432 A * 12/1956 Andreola ..... B65D 47/265 401/263

(Continued)

FOREIGN PATENT DOCUMENTS

| | | |
|---|---|---|
| FR | 3018534 | 9/2015 |
| WO | 2007133096 | 11/2007 |
| WO | 2010136040 | 12/2010 |

OTHER PUBLICATIONS

International Preliminary Report on Patentabilty for corresponding PCT Application No. PCT/CA2019/051175 dated Mar. 2, 2021.

(Continued)

*Primary Examiner* — Paul R Durand
*Assistant Examiner* — Randall A Gruby
(74) *Attorney, Agent, or Firm* — Emerson, Thomson & Bennett, LLC; Roger D. Emerson; Peter R. Detorre

(57) ABSTRACT

An applicator for dispensing a viscous material from a container. The applicator comprises a nozzle for fluid communication with the container. The nozzle has an outlet at a first end and base in proximity to an opposed second end. The nozzle further includes a support arm spaced apart from the nozzle. The support arm and the nozzle collectively forming a slot therebetween for releasably receiving a blade. An attachment portion extend from the base and is configured to releasably engage the container to permit material within the container to flow under pressure through the nozzle and onto a surface. When the blade is received within the slot, it contacts the material as it exits the nozzle and assists in forming the material into a desired shape or configuration.

13 Claims, 11 Drawing Sheets

(51) Int. Cl.
*B65D 47/42* (2006.01)
*E04F 21/165* (2006.01)

(52) U.S. Cl.
CPC .. *B05C 17/00513* (2013.01); *B05C 17/00586* (2013.01); *B65D 47/42* (2013.01); *E04F 21/1652* (2013.01); *E04F 21/1655* (2013.01)

(56) References Cited

U.S. PATENT DOCUMENTS 2,982,987 A * 5/1961 Knapp ..... B43M 11/06 401/139
3,133,300 A * 5/1964 Freeman ..... B65D 47/42 401/139
4,570,834 A * 2/1986 Ward ..... B05C 21/00 222/566
5,017,113 A * 5/1991 Heaton ..... E04F 21/1655 425/87
5,075,916 A * 12/1991 Englehart ..... E04F 21/1652 15/245.1
5,301,843 A * 4/1994 Groene ..... B65D 51/32 222/192
5,643,403 A * 7/1997 Poole ..... A47L 11/38 15/104.94
5,797,692 A * 8/1998 Poole ..... B05C 17/00506 401/139
5,865,555 A 2/1999 Dawson
6,375,377 B1 4/2002 Lowery
7,695,210 B1 4/2010 Martinez
8,256,978 B2 * 9/2012 Bencsics ..... E04F 21/163 401/268
8,308,389 B2 * 11/2012 Yu ..... B65D 25/2802 401/261
8,419,401 B2 * 4/2013 McMahon ..... E04F 21/165 425/87
8,662,780 B2 * 3/2014 Fontana ..... A45D 34/04 401/266
D718,131 S * 11/2014 Brown ..... D9/447
9,259,757 B1 2/2016 Santarsiero
9,637,935 B2 * 5/2017 Chen ..... E04F 21/1652
D803,054 S * 11/2017 van Spronsen ..... D9/443
D813,669 S * 3/2018 Pentland ..... D9/447
10,087,640 B2 * 10/2018 Kraskov ..... E04F 21/1652
10,746,951 B2 * 8/2020 Bradley ..... G02B 6/4466
D898,569 S * 10/2020 Pentland ..... D9/447
D898,570 S * 10/2020 Pentland ..... D9/447
10,960,431 B1 * 3/2021 Elam ..... E04F 21/1652
2010/0162509 A1 * 7/2010 Liao ..... E04F 21/1655 15/235.7
2010/0278958 A1 11/2010 Chamberlain et al.
2011/0164917 A1 7/2011 Yu
2013/0029085 A1 * 1/2013 Liao ..... E04F 21/1655 428/81
2013/0207348 A1 8/2013 Smeets
2014/0212200 A1 7/2014 Liao
2014/0275529 A1 9/2014 Traynelis
2016/0167081 A1 6/2016 Kim
2021/0308714 A1 * 10/2021 Pentland ..... B05C 17/00583

OTHER PUBLICATIONS

International Search Report for corresponding PCT Application No. PCT/CA2019/051175 dated Oct. 7, 2019.
Written Opinion for corresponding PCT Application No. PCT/CA2019/051175 dated Sep. 20, 2019.

* cited by examiner

APPLICATOR WITH INTERCHANGEABLE HEADS

CROSS-REFERENCE TO RELATED APPLICATIONS

The application claims all benefit including priority to U.S. Provisional Patent Application 62/724,304, filed on Aug. 29, 2018, the contents of which are incorporated herein by reference.

FIELD

The present invention relates to the field of applicators for dispensing viscous materials from tubes, casings, sleeves, cartridges or other types of containers.

BACKGROUND

Caulking, adhesives, silicone, drywall compound, spackle, plaster, and other such materials are often sold in tubes, flexible casings, cartridges, and the like. When sold in such manners, these types of materials are typically dispensed through the application of pressure to the casing or container, forcing the material through a nozzle at one end. Where the material in question is contained within a flexible tubular casing, one end may be sealed such that applying pressure to the exterior circumference of the casing causes the material to be extruded through a nozzle at the opposite end, much like in the case of a tube of toothpaste.

Commonly, the nozzles through which viscous or semi-viscous materials are extruded are somewhat elongate and conical in nature, permitting an individual to cut the end of the nozzle to allow for the dispensing of material through a resulting hole. The nozzle may be cut either perpendicular to its longitudinal axis or at an angle, as may be desired for any particular application. For example, where the material is a silicone material that is to be applied at the juncture between a shower wall and a shower base, an individual may choose to cut the nozzle at an angle of approximately 45 degrees. The angled tip of the nozzle helps the individual to apply a bead of silicone at the juncture in a manner that both seals the juncture and that presents a visually appealing result.

While such existing nozzles can be effectively used, at times the amount of material that is extruded through the nozzle, the shape in which the material is extruded, the rate at which the nozzle is drawn across a surface, and inconsistencies in the surface to which the material is being applied can result in an excessive amount of material being extruded, a build-up of material, holes or gaps in the application of material, and other undesirable results. Even in the hands of a highly trained professional, there can be instances when an individual is required to use his or her hands, fingers or another object or tool to remove excessive material, to fill in gaps or holes in the dispensed material, or to otherwise smooth or even out the material in order to make it more aesthetically pleasing. In such instances there can be a waste of material and it is typically always an inefficient use of the individual's time.

To address such difficulties, others have suggested the use of nozzles having blades of particular shapes that are uniquely designed for specific applications. While such nozzles can be more effective than a more traditional nozzle, in most instances they are limited to very particular applications, and they can often be challenging to clean, limiting them to a single use.

SUMMARY

In one aspect the invention there is provided an applicator for dispensing a viscous material from a container, the applicator comprising a nozzle for fluid communication with the container, the nozzle having an outlet at a first end and base in proximity to an opposed second end; a support arm spaced apart from the nozzle, the support arm and the nozzle collectively forming a slot therebetween for releasably receiving a blade; and an attachment portion extending from the base, the attachment portion configured to releasably engage the container to permit material within the container to flow under pressure through the nozzle and onto a surface, the blade, when received within the slot, contacts the material as it exits the nozzle and assists in forming the material into a desired shape or configuration.

In another aspect of the invention there is, in combination, an applicator for fluidly engaging a container, and a blade releasably securable to the applicator, the applicator having a nozzle and a support arm forming a slot therebetween, the blade comprising a body having a first face and an opposed second face, wherein the distance between the first face and the second face is dimensioned to permit the body to be releasably received within the slot.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
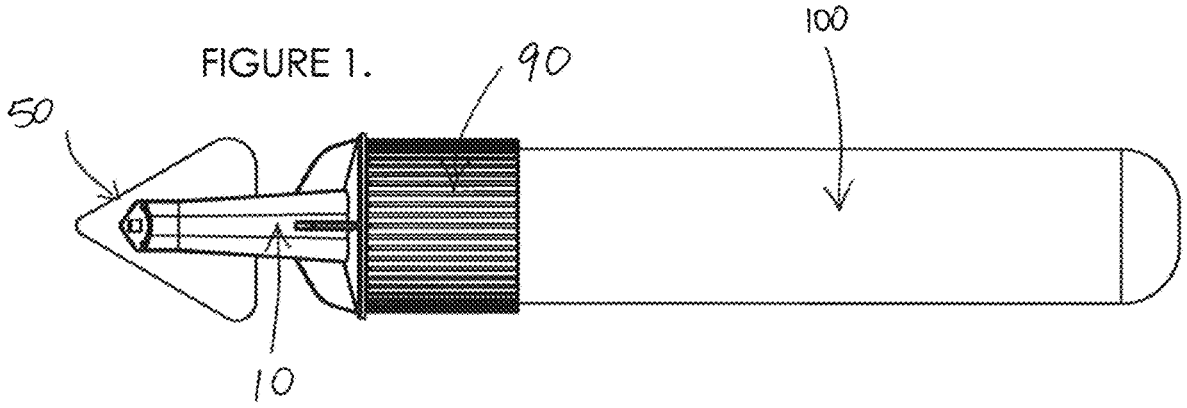
FIG. 1 is a side view of a typical container to which an applicator in accordance with an embodiment of the invention has been secured.
Figure 2:
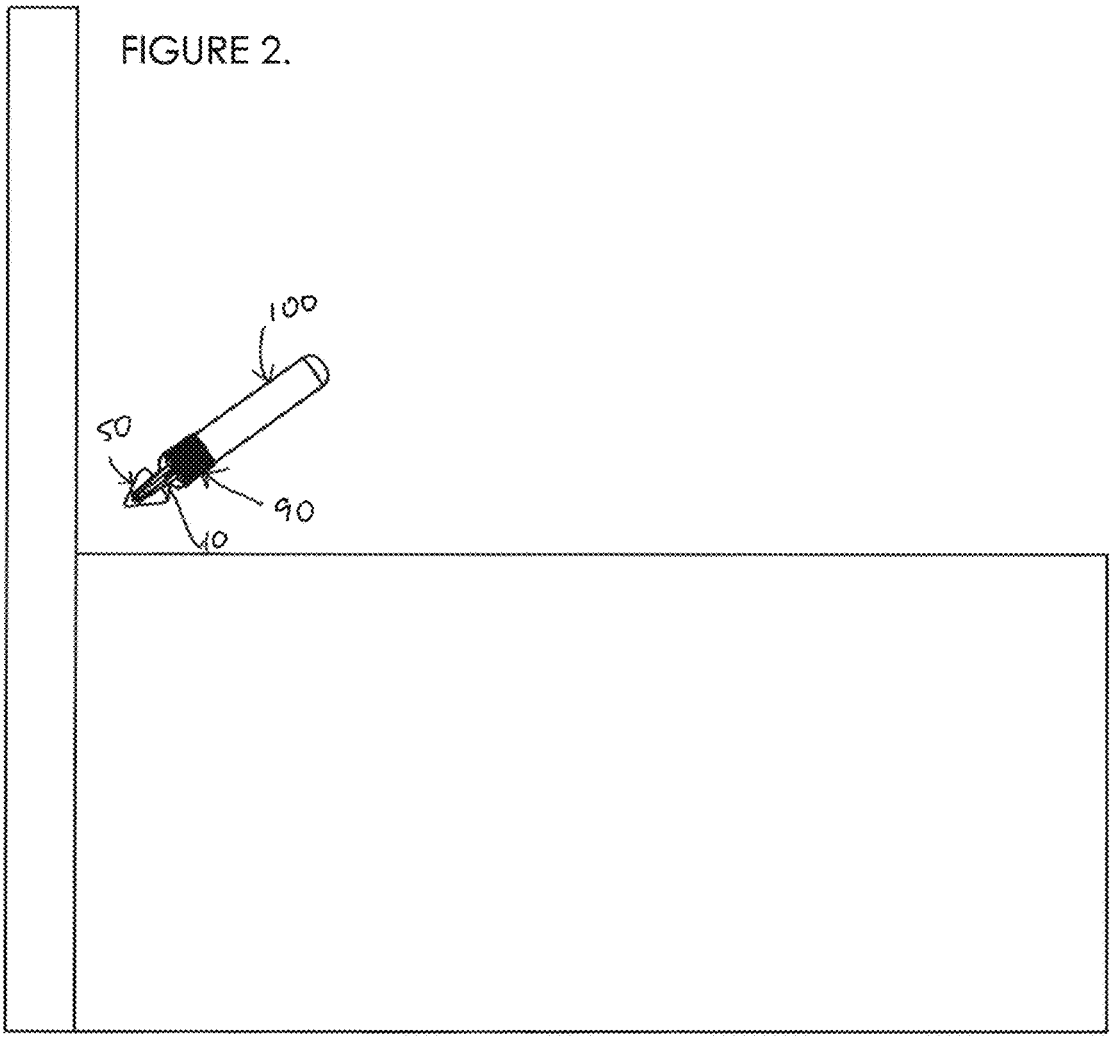
FIG. 2 is a schematic view showing a typical use of the applicator of FIG. 1.

FIGS. 1 and 2 show an example embodiment of the invention wherein an applicator 10, in combination with a releasable blade 50, is coupled to a container 100. In the depicted embodiment, a collar 90 is secured to an end portion of container 100. Applicator 10 may then be releasably coupled to collar 90, thereby allowing applicator 10 to be releasably secured to container 100. Container 100 in this embodiment is a flexible casing containing viscous material. The container may take on different forms and different structures in alternate embodiments.

FIGS. 3 to 7 show applicator 10 in isolation. Applicator 10 primarily comprises a nozzle portion, an annular base 14, and an attachment portion 18. The nozzle portion includes a slot 30 for releasably receiving blade 50. In the embodiments depicted, the nozzle portion includes a nozzle 12 and a support art 16, which collectively define slot 30.

Nozzle 12 includes a passageway for fluid communication with container 100, and has a first end 20 and an opposed second end 22. An outlet 24 is positioned at first end 22. Typically, in prior devices nozzle outlets have been circular or square-shaped. In the depicted embodiment, outlet 24 is triangular shaped. The triangular shape of outlet 24 forms a corner or apex 26 that permits nozzle 12 to be seated close to a corner in a wall or other juncture during use. Triangular outlet 24 further helps to shape and pre-form the viscous or semi-viscous material being extruded from container 100 into a bead having a generally triangular profile. The ability of outlet 24 to be seated close to a corner, and the generally triangular pre-formed material that is extruded, assists in helping to apply the material close to a corner, with potentially less waste and less air entrainment or air gaps. The triangular shaped bead of material that is created also presents a finished surface that forms an approximate 45 degree across a corner, leaving an aesthetically pleasing appearance.

Annular base 14 extends outwardly from opposed second end 22 of nozzle 12 and includes an inlet 23 for receiving material from casing 100. The passageway in nozzle 12 fluidly connects inlet 23 to outlet 24. In addition to generally providing structural support for applicator 10, annular base 14 also serves as a stop when applicator 10 is releasably coupled to collar 90. As shown in FIG. 1, annular base 14 abuts with collar 90 when applicator 10 is coupled thereto.

Support arm 16 extends from annular base 14 generally parallel to, and spaced apart from, nozzle 12. Support arm 16 and nozzle 12 each have an internal wall, 28*a* and 28*b*, respectively, which face one another to collectively form slot 30 therebetween. As noted above, slot 30 is configured to releasably receive blade 50.

Support arm 16 includes tabs 32 extending from, and generally parallel to, its internal wall 28*a*. Tabs 32 are configured to engage and grip blade 50, and be formed from a resiliently flexible material for a snap-fit engagement with blade 50.

Figure 11:
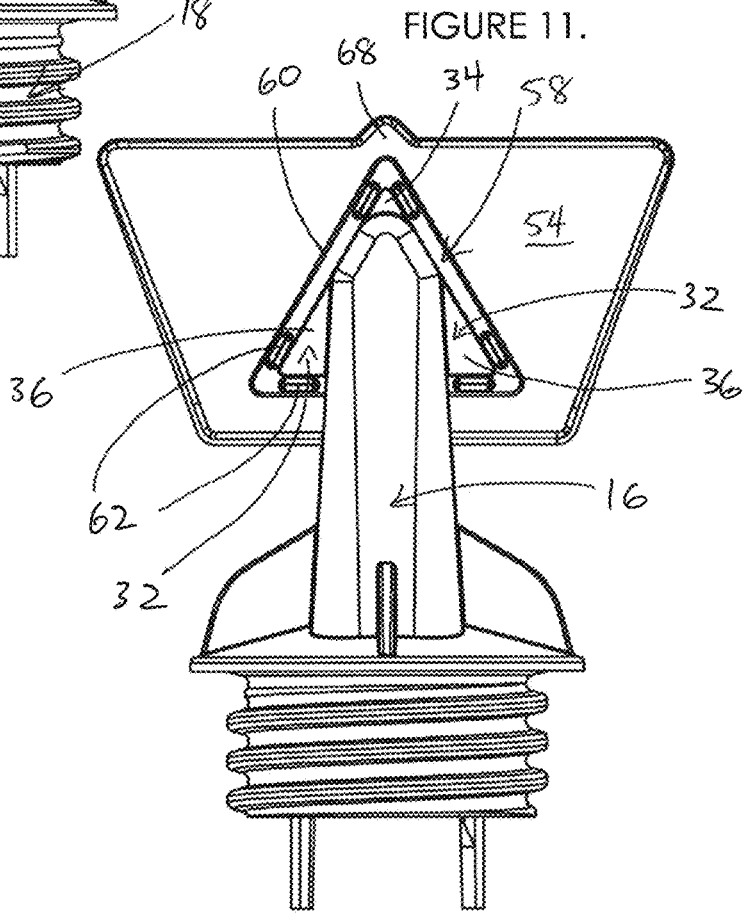
FIG. 11 is a second side view of the applicator and blade, opposite to that shown in FIG. 9.

In the depicted embodiment, tabs 32 of support arm 16 include a leading tab 34 at the distal end of support arm 16 and a pair of flanking tabs 36. As shown in FIG. 11, leading tab 34 and flanking tabs 36 may collectively form an equilateral triangle shape about the outer portion of support arm 16. Leading tab 34 and flanking tabs 36 are also co-planar with internal wall 28*a*, thereby effectively extending the surface area of internal wall 28*a* of support arm 16 (see FIG. 6).

While three tabs are shown in the depicted embodiment, as will be understood by the skilled person, support arm 16 may have one, two, or more than three tabs. They may also extend from different positions along support arm 16. While the tabs shown in the attached drawings collectively form an equilateral triangle, other polygonal shapes, may instead be formed. Tabs 32 and wall 28*a* may alternatively together form a circular, or otherwise curved, shape.

Attachment portion 18 extends from annular base 14 and, as noted above, is configured to releasably engage collar 90, and to thereby be coupled, in fluid communication, to container 100. In the depicted embodiment, attachment portion 18 is externally threaded with threads 38 that engage with internal threads in collar 90.

Container 100 may include a label (not shown). Threads 38 of attachment portion 18 may be indexed (i.e. sized and spaced apart) to allow alignment of blade 50 with the label when applicator 10 is coupled to collar 90.

Attachment portion 18 may further includes a pair of legs 40 which project from annular base 14, and extend past threads 38. Legs 40 each have a sharp cutting edge 42. Each leg 40, and more particularly each cutting edge 42, is brought into contact with the end of container 100 when applicator 10 is threaded into collar 90. In this manner, cutting edges 42 serve to cut through a portion of container 100 to allow the material within container 100 to be extruded into and through applicator 10. Such a structure is particularly useful where container 100 is a relatively thin flexible casing, such as that shown in the attached drawings.

Figure 3:
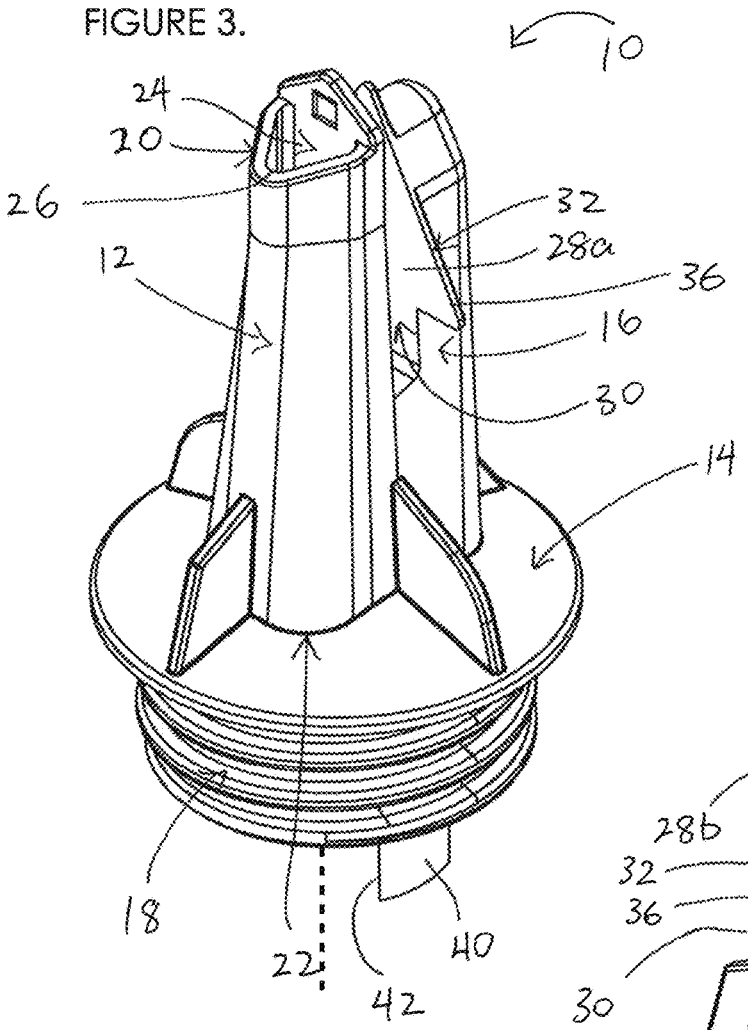
FIG. 3 is an upper side perspective view of an applicator constructed in accordance with the present invention having its blade removed.
Figure 4:
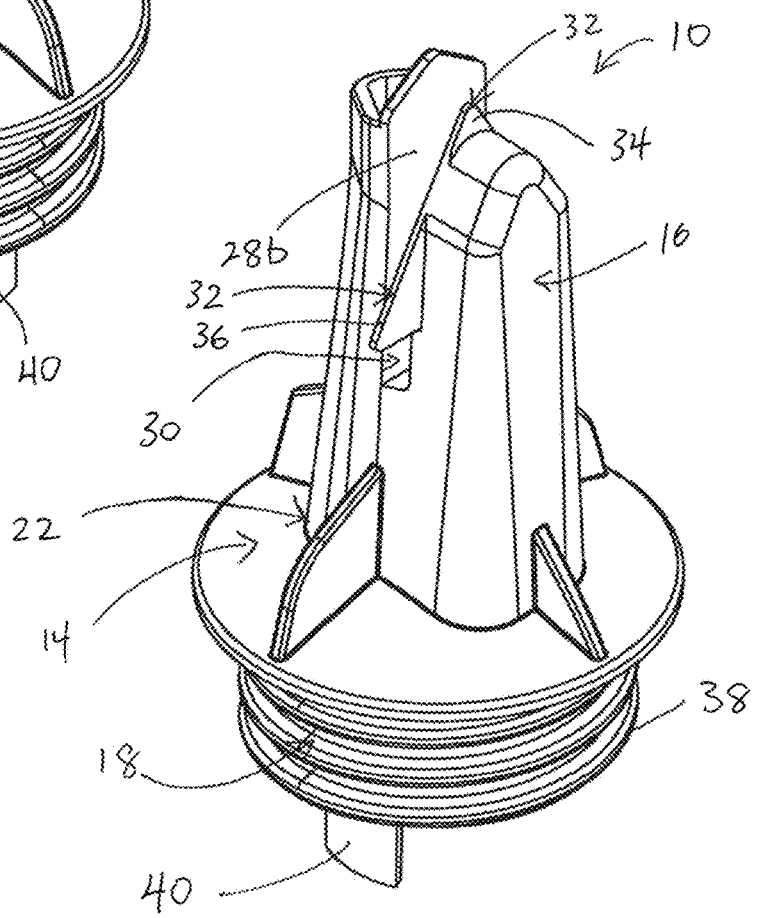
FIG. 4 is an upper side perspective view opposite to that shown in FIG. 3.
Figure 5:
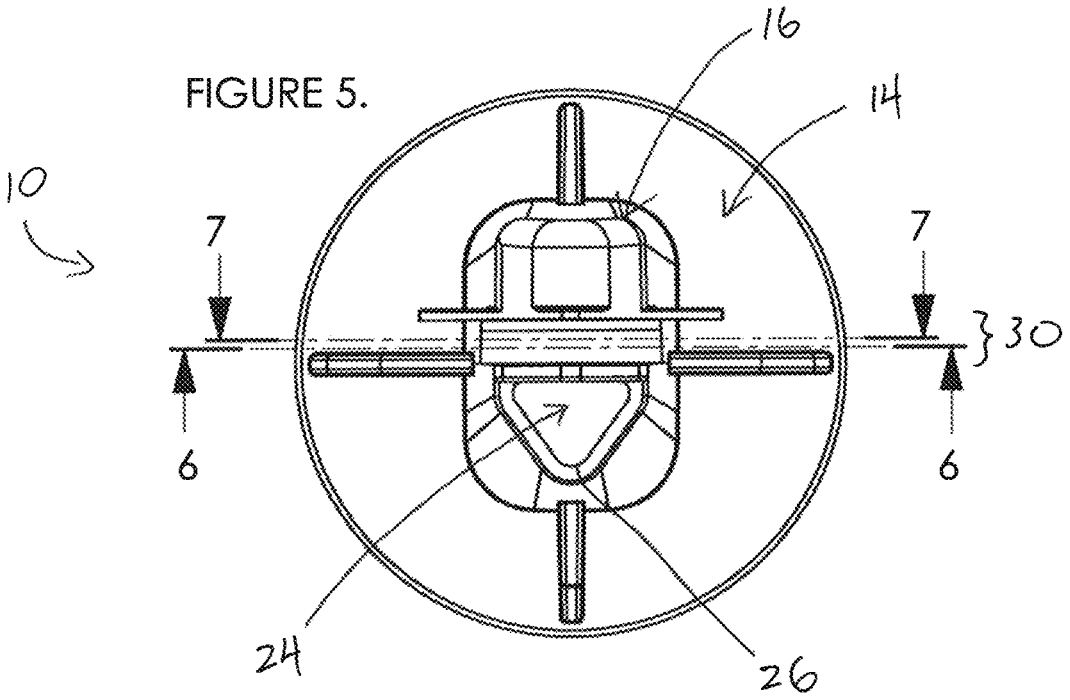
FIG. 5 is a plan view of the applicator shown in FIG. 3.
Figure 6:
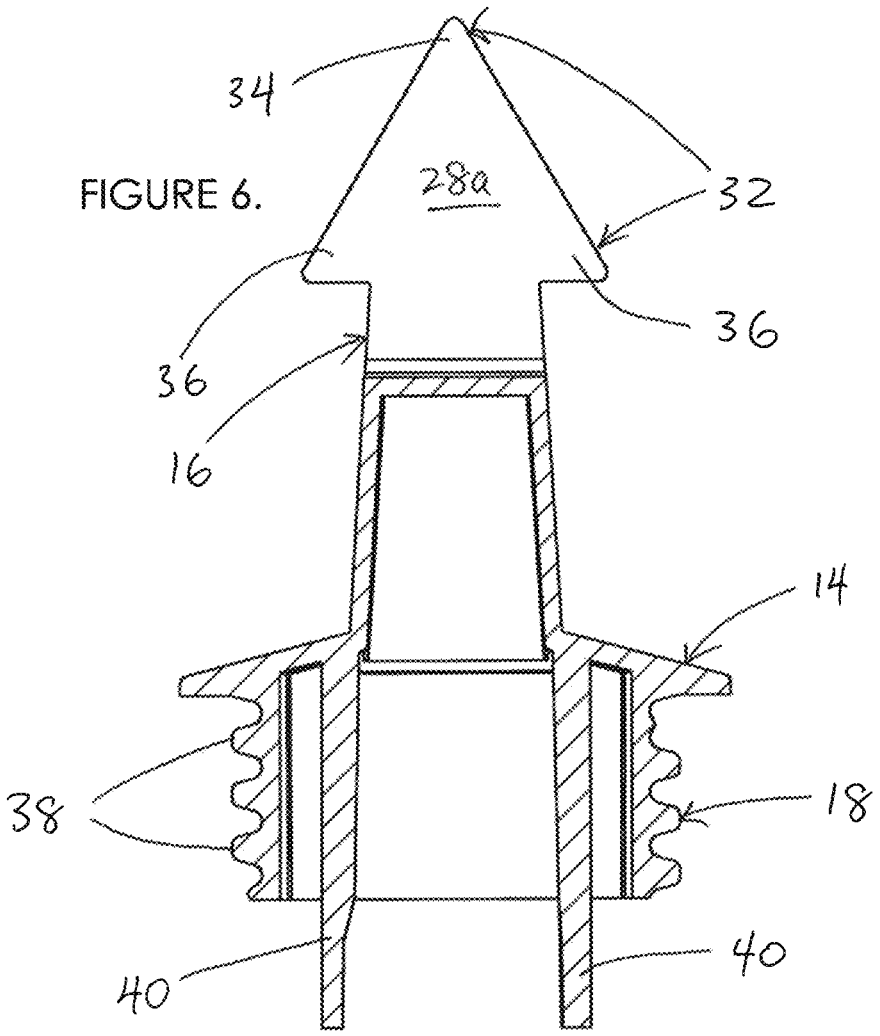
FIG. 6 is a sectional view taken along the line 6-6 of FIG. 5.
Figure 7:
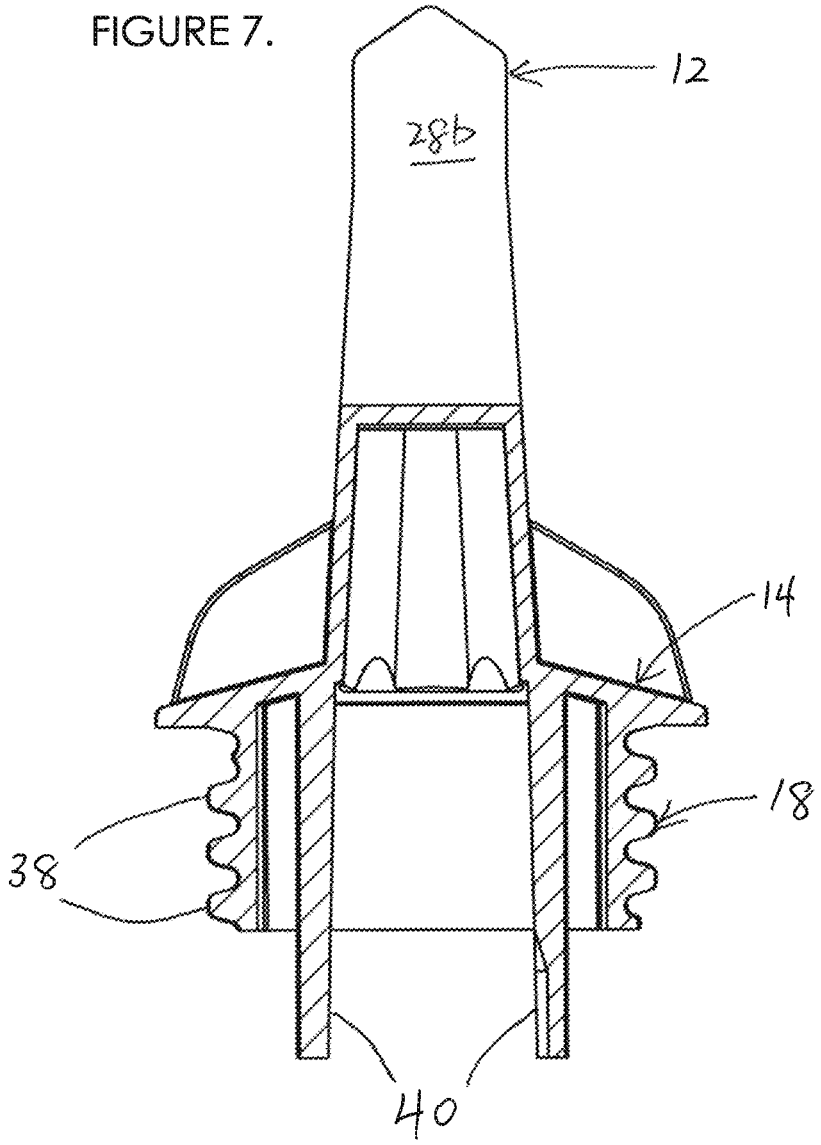
FIG. 7 is a sectional view taken along the line 7-7 of FIG. 5.
Figure 8:
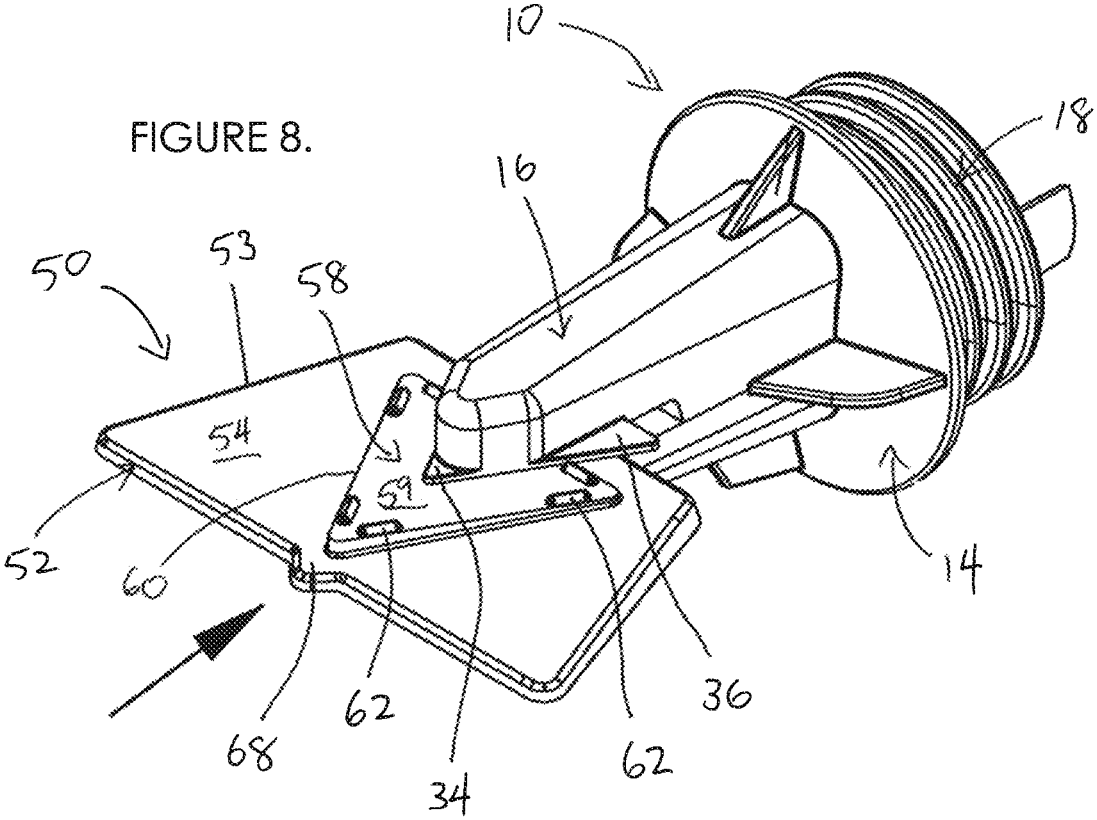
FIG. 8 is an upper perspective view of the applicator of FIG. 3 showing a blade partially inserted therein.
Figure 9:
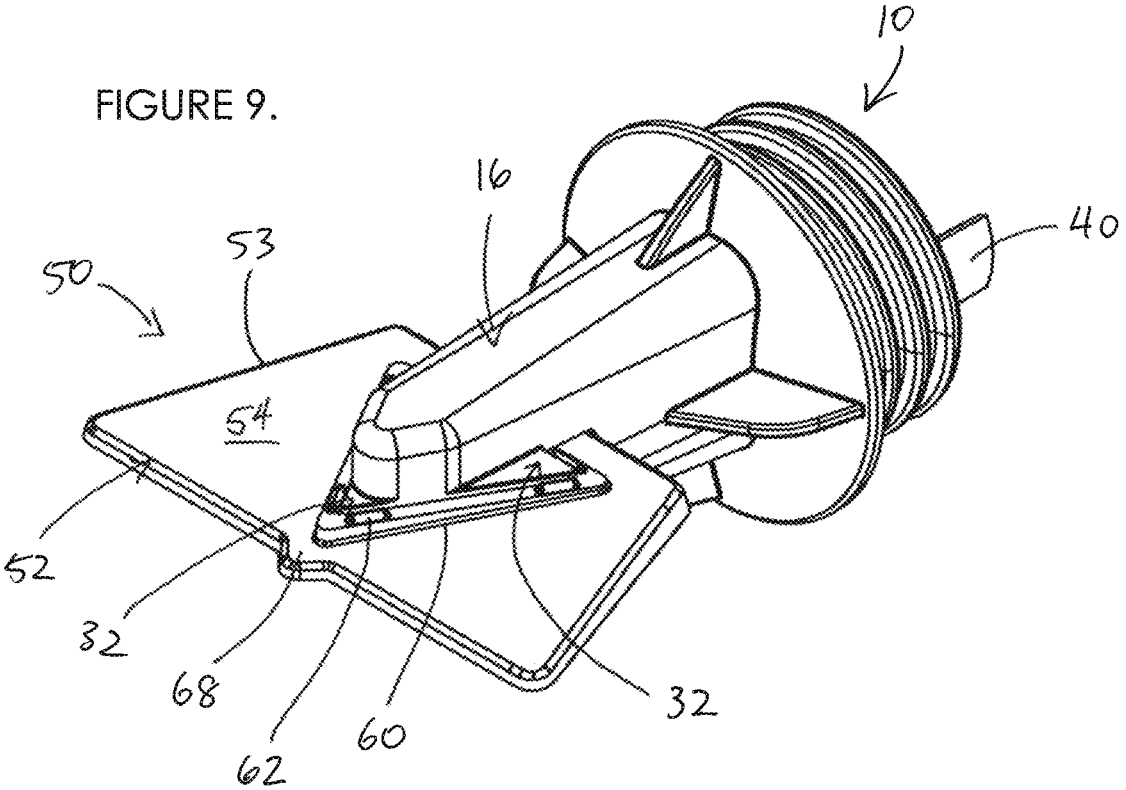
FIG. 9 is a view similar to FIG. 8 wherein the blade has been fully received within the applicator.

In the embodiment depicted in FIG. 3, cutting edge 42 is generally parallel to the longitudinal axis (indicated by the dotted line) of attachment portion 18 as each leg 40 extends past threads 38.

Figure 21:
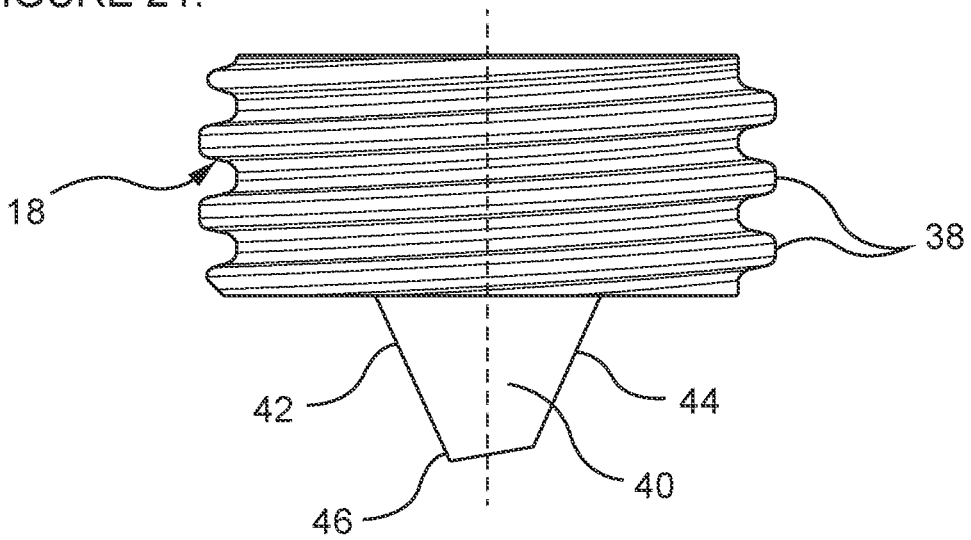
FIG. 21 is a side view of a bottom portion of an alterative embodiment of the applicator according to the present invention.

In an alternate embodiment of leg 40, cutting edge 42 may instead extend at an angle relative to the longitudinal axis of attachment portion 18. The angle may be a "downward" angle as shown in FIG. 21, where the longitudinal axis of attachment portion 18 is indicated with a dotted line. In this manner, when cutting edge 42 encounters a seam in the flexible casing (not shown), the angle of cutting edge 42 helps to push or force the seam downwards into the flexible casing, rather than cutting edge 42 potentially catching on the seam.

Leg 40, as shown, may also includes an edge 44 positioned opposite cutting edge 42 and include a tip 46 at the end of cutting edge 42. Edge 44 is orientated at an angle that is opposite to that of cutting edge 42 relative to the longitudinal axis of attachment portion 18. In this manner, when applicator 10 is rotatably threaded out of collar 90, should edge 44 come into contact with the flexible casing, the angle of edge 44 will help to prevent edge 44 from catching on an uncut seam in the flexible casing. Tip 46 forms a leading pick or point situated at the bottom end of leg 40 to help encourage cutting edge 42 to pierce the flexible casing when applicator 10 is rotatably threaded into collar 90.

As noted, applicator 10 is for use in combination with a blade 50. FIGS. 14-20 show three example embodiments of blades in isolation. In each embodiment, blade 50 has a blade body 52 with a blade perimeter 53.

Blades 50 comprise a first face 54 and opposed second face 56 with a raised platform 58 positioned on first face 54. The thickness of raised platform 58 is such that it releasably fits within slot 30. As discussed in more detail below, raised platform 58 is further configured to engage with tabs 32 on support arm 16.

In the depicted embodiments, raised platform 58 has a triangular shape (generally corresponding with the combined shape of tabs 32), with a top surface 59 and a perimeter 60. Raised platform 58 includes multiple ribs or protrusions 62 for engagement with tabs 32. Protrusions 62 are positioned to at least partly surround and retain tabs 32 when blade 50 is received within slot 30. In the embodiment shown, a pair of protrusions 62 are positioned on top surface 59 next to each corner of raised platform 58. As will be described in more detail below, the flexible resilience of tabs 32 allows them to deflect over protrusions 62 and to be received or "snap" into the space between the protrusions. It will thus be appreciated that when blade 50 is received within slot 30 each of tabs 32 will be received between a pair of protrusions.

Raised platform 58 is shown to include at least one ramp 64. Ramp 64 creates an inclined transition between first face 54 and top surface 59, permitting leading tab 34 to slide more easily onto raised platform 58 when blade 50 is received within slot 30.

Rather than a triangular shape, raised platform 58 may alternately have a different polygonal, possibly equilateral polygonal, shape. Raised platform 58 may also instead have a circular, or otherwise curved, form. As a further alternative, protrusions 62 may be arranged in a different configuration on raised platform 58, for example, protrusions 62 may be spaced further away from platform perimeter 60, provided that tabs 32 snap-fit into the space between protrusions 62.

Figure 14:
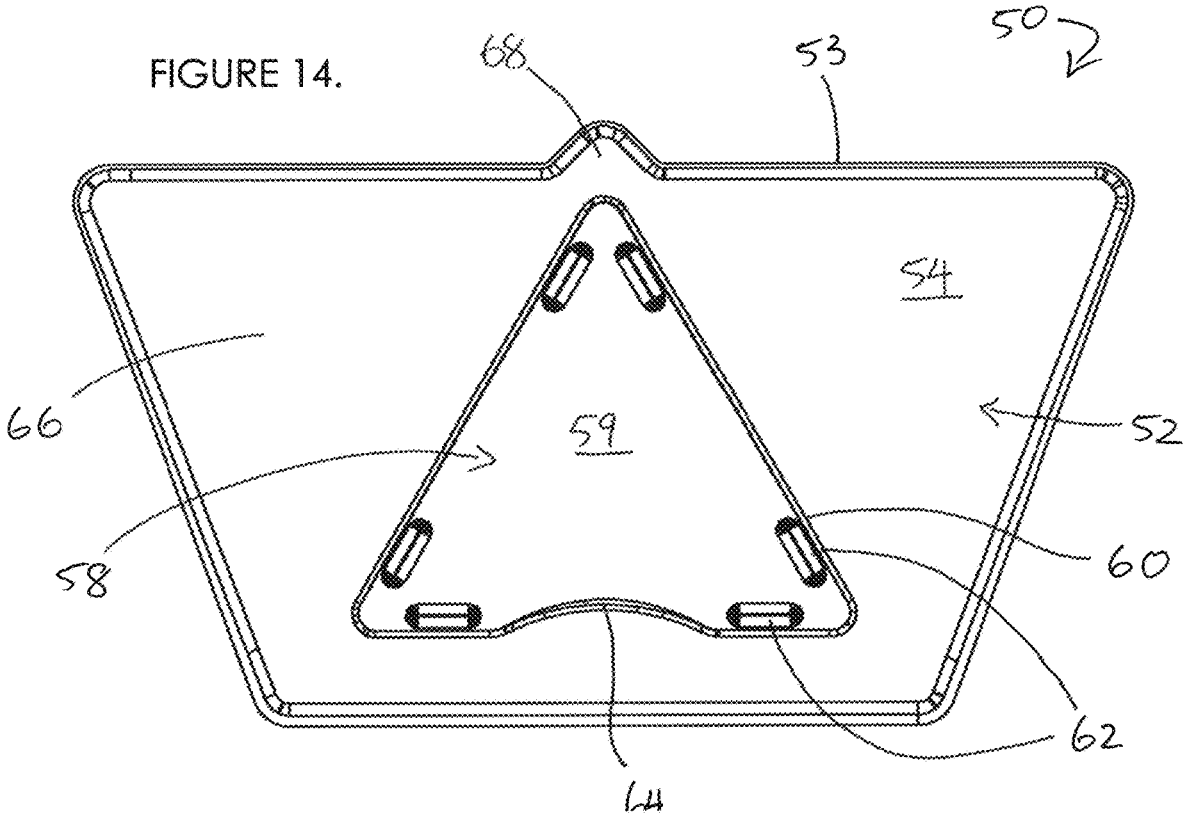
FIG. 14 is a side view of the blade shown in FIG. 8.
Figure 15:
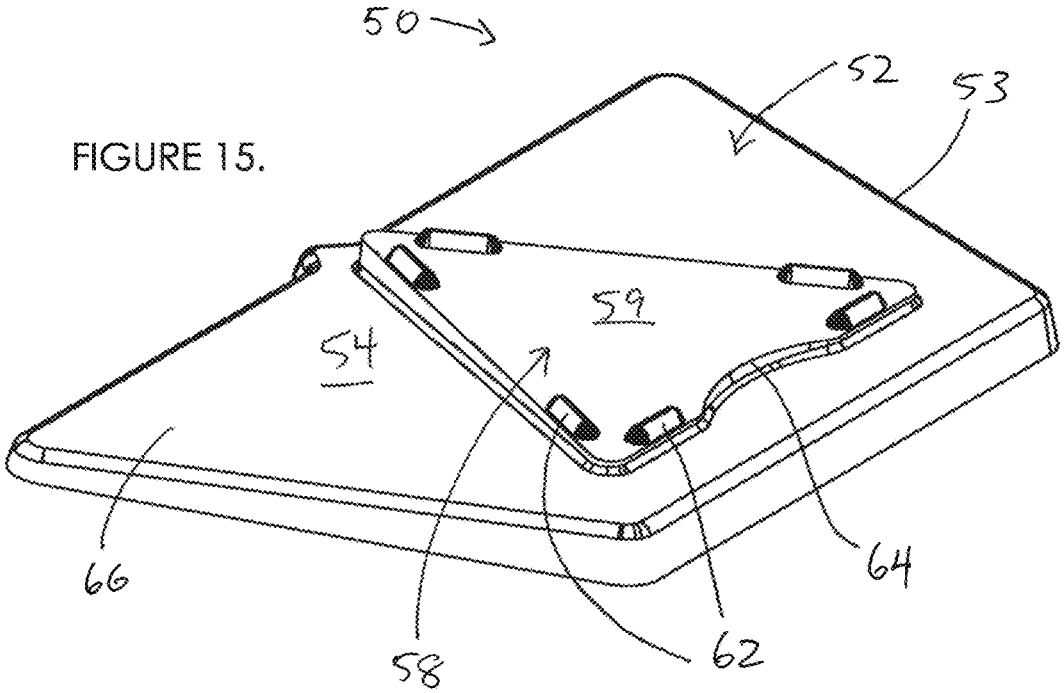
FIG. 15 is an upper side perspective view of the blade shown in FIG. 14.
Figure 16:
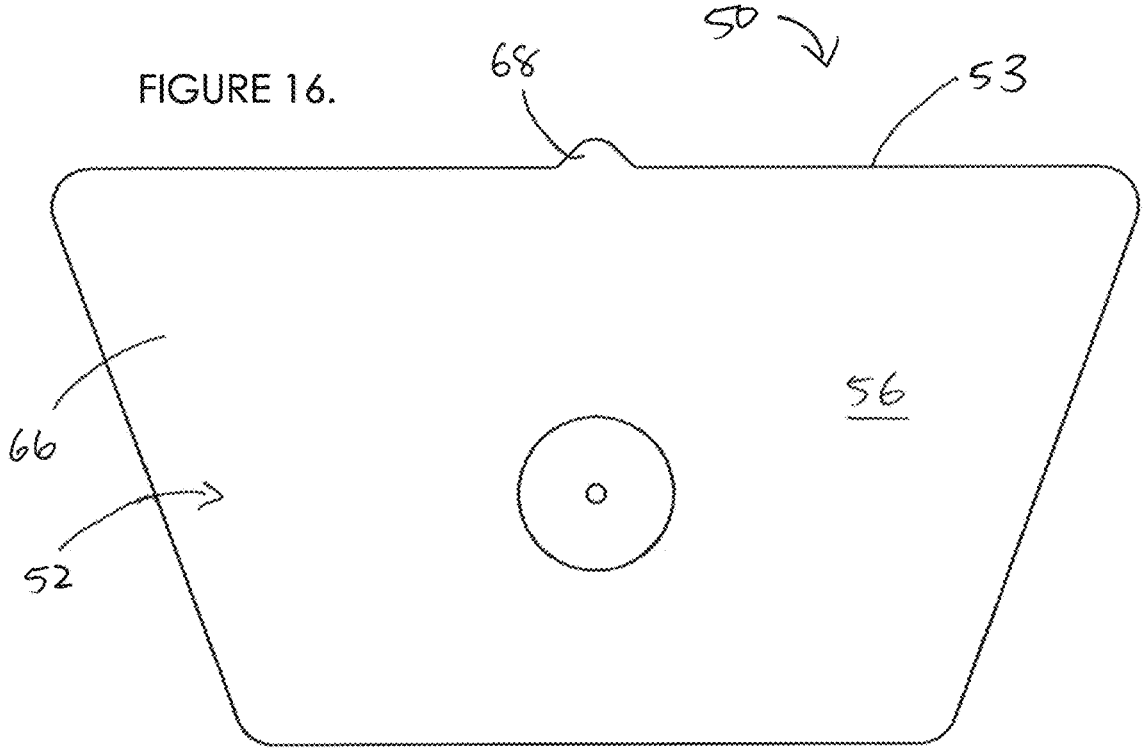
FIG. 16 is a side view, opposite to that shown in FIG. 14.
Figure 17:
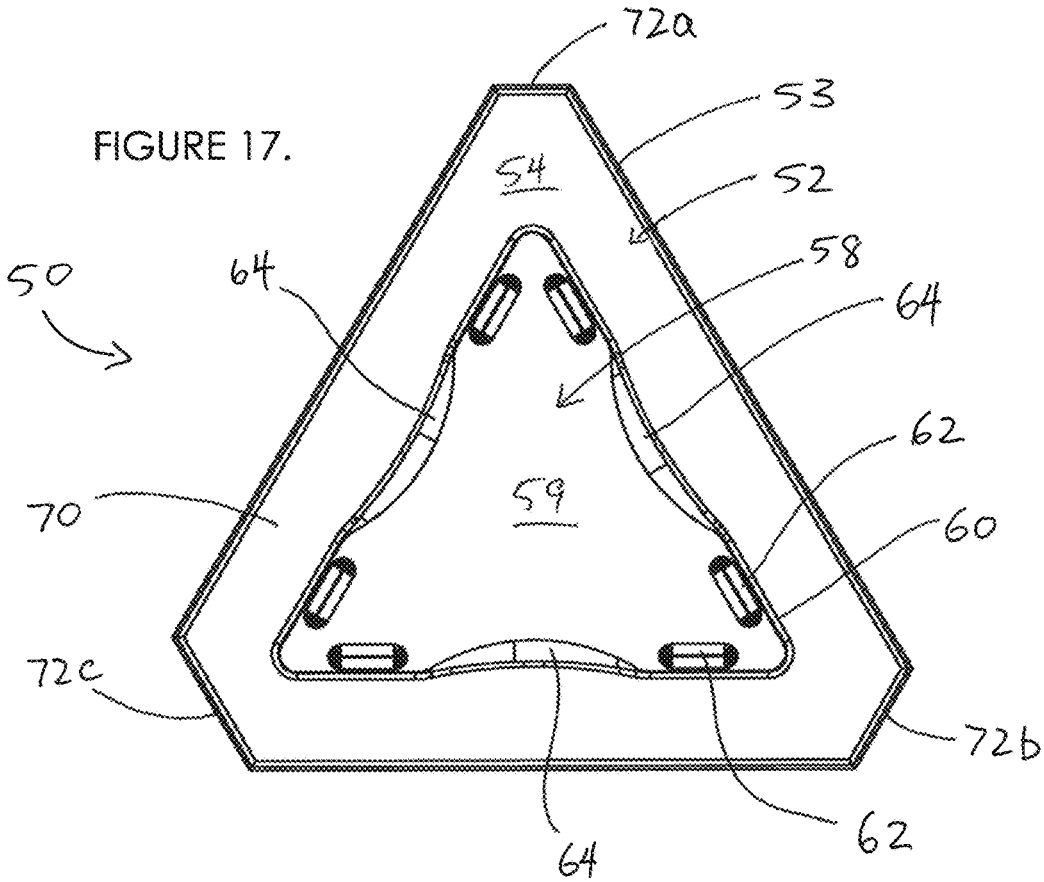
FIG. 17 is a side view of an alternate embodiment of a blade for the applicator shown in FIG. 3.
Figure 18:
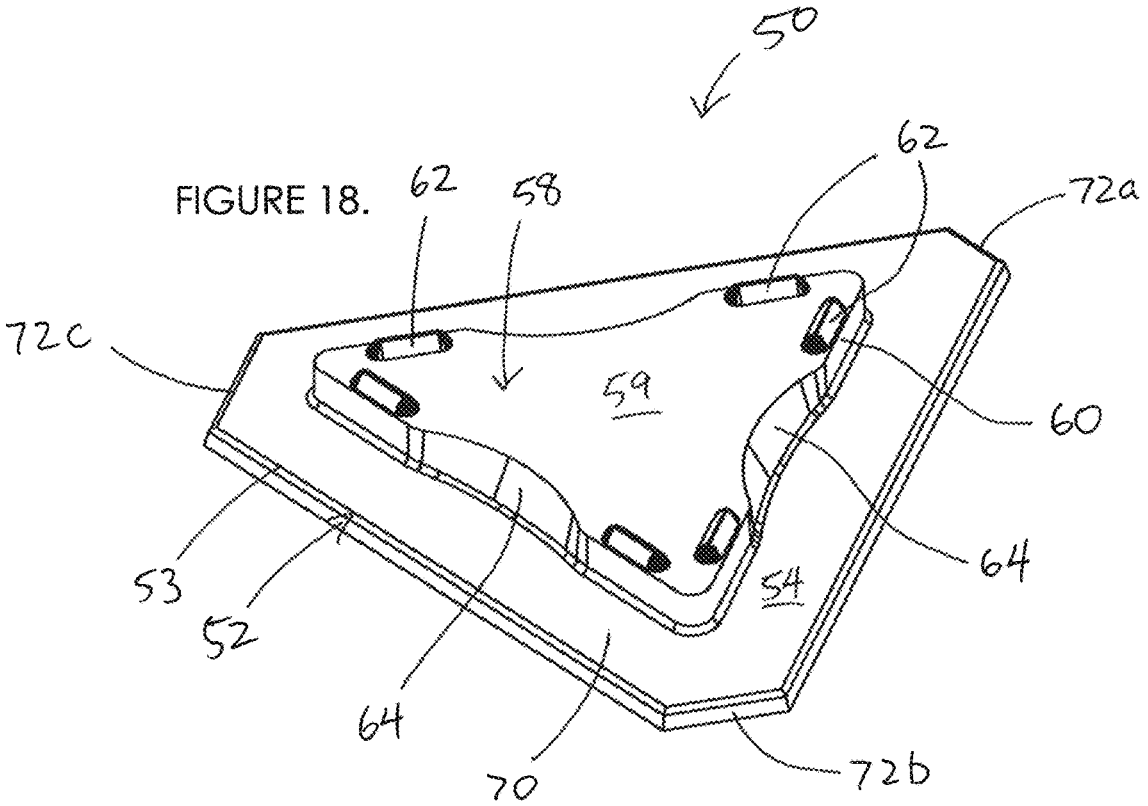
FIG. 18 is an upper side perspective view of the blade shown in FIG. 17.
Figure 19:
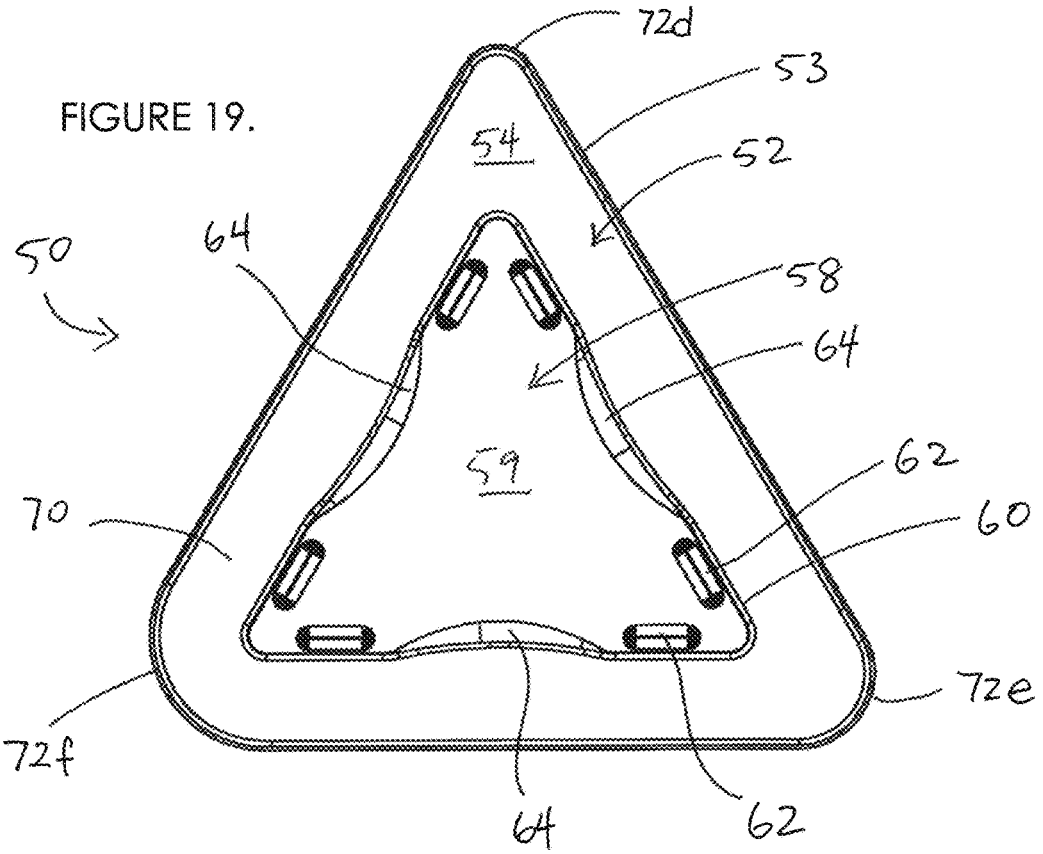
FIG. 19 is a side view of a further alternate embodiment of a blade for the applicator shown in FIG. 3.
Figure 20:
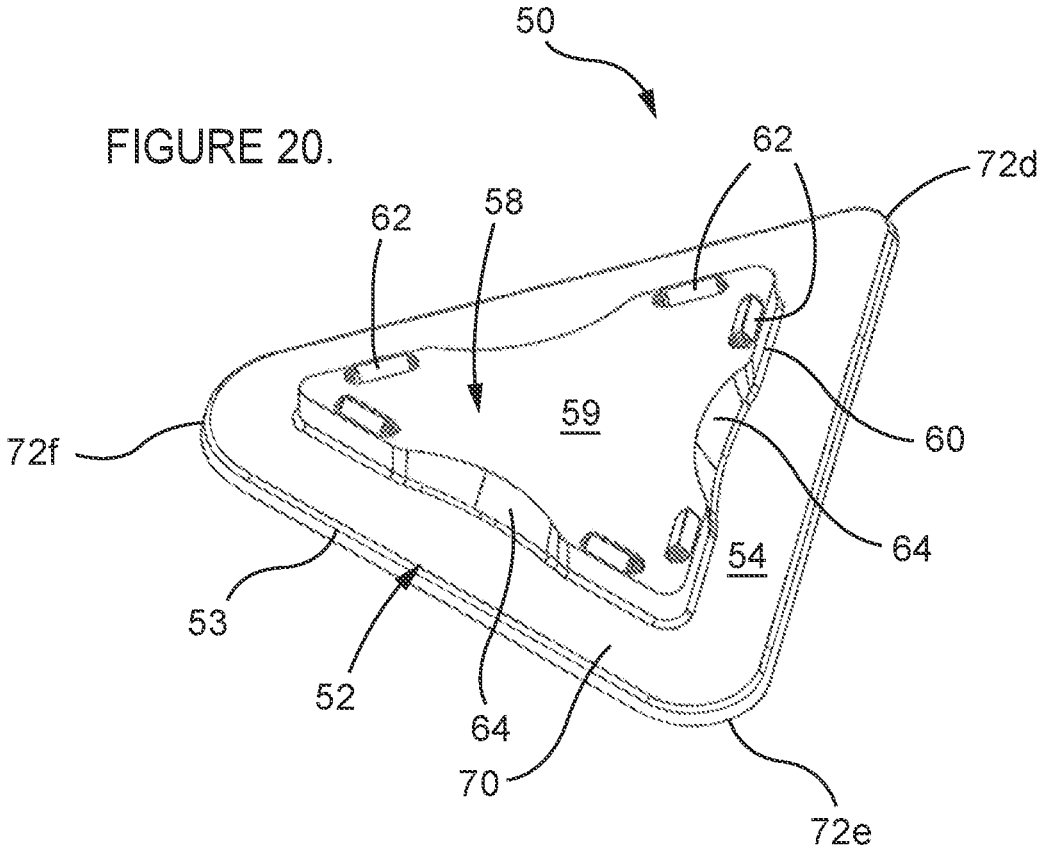
FIG. 20 is an upper side perspective view of the blade shown in FIG. 19.

FIGS. 14-16 illustrate one embodiment of blade 50, FIGS. 17-18 illustrate a second embodiment, and FIGS. 19-20 illustrate a third embodiment. In the embodiment shown in FIGS. 14-16, blade body 52 has a generally trapezoidal shape, hereinafter referred to as a trapezoidal blade 66. This shape may be useful when applying material onto a flat surface as the blade has a relatively long leading edge that is approximately perpendicular to the axis of nozzle 12. While the leading edge of trapezoidal blade 66 may be smooth and straight, trapezoidal blade 66 may further include a nub 68 positioned centrally along its leading edge. This nub 68 may be useful when applying material between tiles as nub 68 may be of assistance in maintaining an aesthetically pleasing grout line. Raised platform 58 in the embodiment of FIGS. 14-15 preferably includes a single ramp opposite nub 68.

In the embodiment shown in FIGS. 17-18, blade body 52 has a generally triangular shape, hereinafter referred to as a triangular blade 70. This shape may be useful when applying material within corners. Triangular blade 70 is shown to be generally equilateral, with each corner having a unique corner or profile 72*a*, 72*b*, and 72*c*. In this embodiment, corners 72*a*, 72*b*, and 72*c* are flat edges which vary in terms of length. Raised platform 58 in the embodiment of FIGS. 17-18 includes three ramps 64, each situated along and proximate a straight portion of perimeter 53 of triangular blade 70.

The embodiment shown in FIGS. 19-20 is largely similar to that shown in FIGS. 17-18. The primary difference in this embodiment is that corners 72*d*, 72*e*, and 72*f* are rounded, each having a different radius. It will be appreciated that a different profile of material deposited by nozzle 12 can thus be achieved, depending upon the orientation of blade 50 when received within slot 30.

Where blade 50 is triangular it will typically have three ramps 64, such that leading tab 34 can be received over any one of the three ramps 64 to retain the triangular blade in a desired orientation. Outlet 24 of nozzle 12 will this be located in proximity to one of corners 72*a*, 72*b*, 72*c*, 72*d*, 72*e*, or 72*f*. The triangular blade may then be rotated and received within slot 30 in three different orientations, depending on the shape and size of the bed of material that is desired. The user is thus able to select and use the profile that best matches the application at hand. Other shaped blades my alternately be used, with the same rotational advantage.

It will be understood by the skilled person that blade body 52 may have a different shape, including a different polygonal shape, depending on the desired application of the viscous/semi-viscous material. Blade body 52 may alternatively have a circular, or otherwise curved, form.

Leading tab 34 on support arm 16 may be used to help facilitate the receipt of blade 50 into slot 30. As the blade is inserted into slot 30, tab 34 engages ramp 64 to force tab 34 onto raised platform 58. Ramp 64 thus allows for an easier transition of leading tab 34 onto raised platform 58. As flanking tabs 36 come into contact with protrusions 62, the flexible resilience of flanking tabs 36 allows flanking tabs 36 to deflect over protrusions 62 and "snap" into place between the protrusions. At the same time, leading tab 34 will snap into place or be received between its associated protrusions, resulting in blade 50 being securely held in slot 30.

In the attached Figures, top surface 59 of raised platform 58 is larger than the shape formed by tabs 32 such that when blade 50 is received within slot 30, internal wall 28*a* contacts top surface 59. The thickness of blade 50 is configured such that internal wall 28*b* of nozzle 12 contacts or is in close proximity to second face 56 when blade 50 is received within slot 30. The combination of internal wall 28*a* of support arm 16 contacting top surface 59, and internal wall 28*b* of nozzle 12 contacting second face 56, generally grips and holds blade 50 in place.

Figure 10:
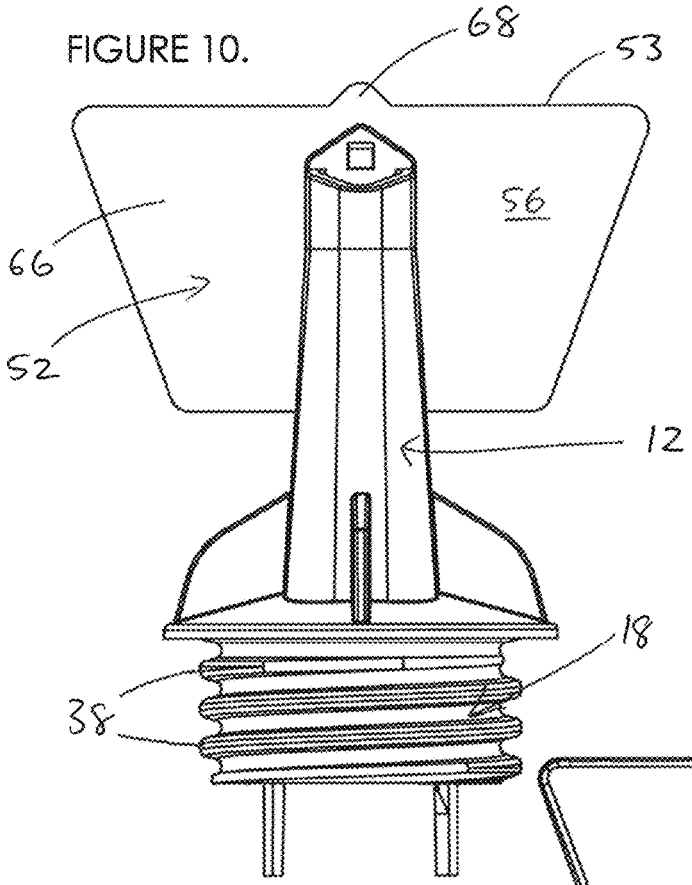
FIG. 10 is a first side view of the applicator and blade shown in FIG. 9.
Figure 12:
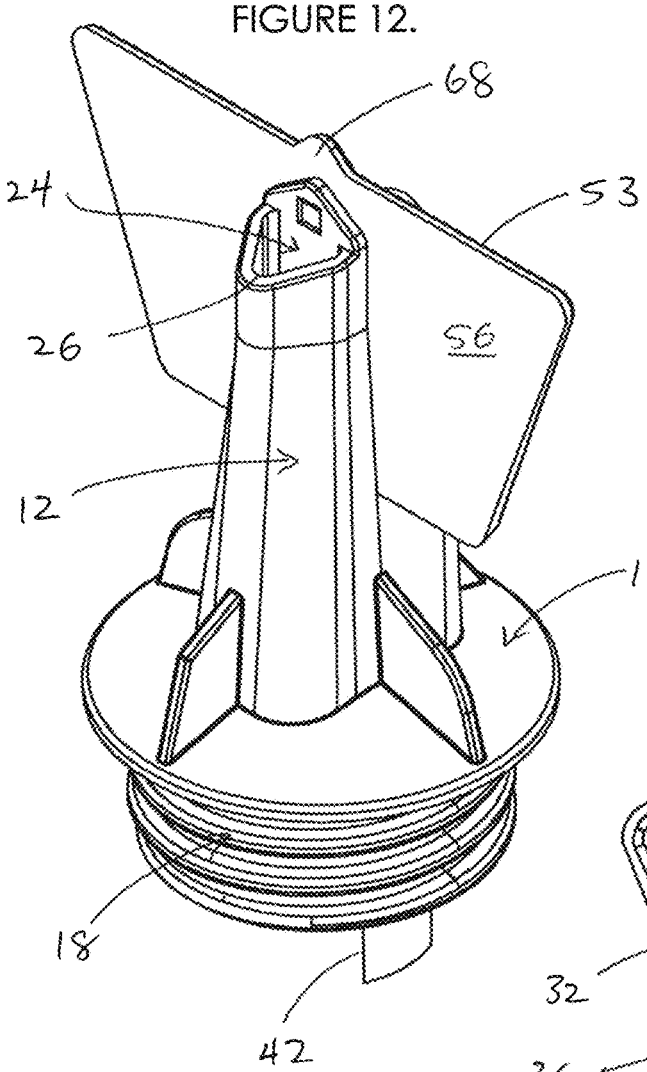
FIG. 12 is a side perspective view of the applicator and blade shown in FIG. 8.
Figure 13:
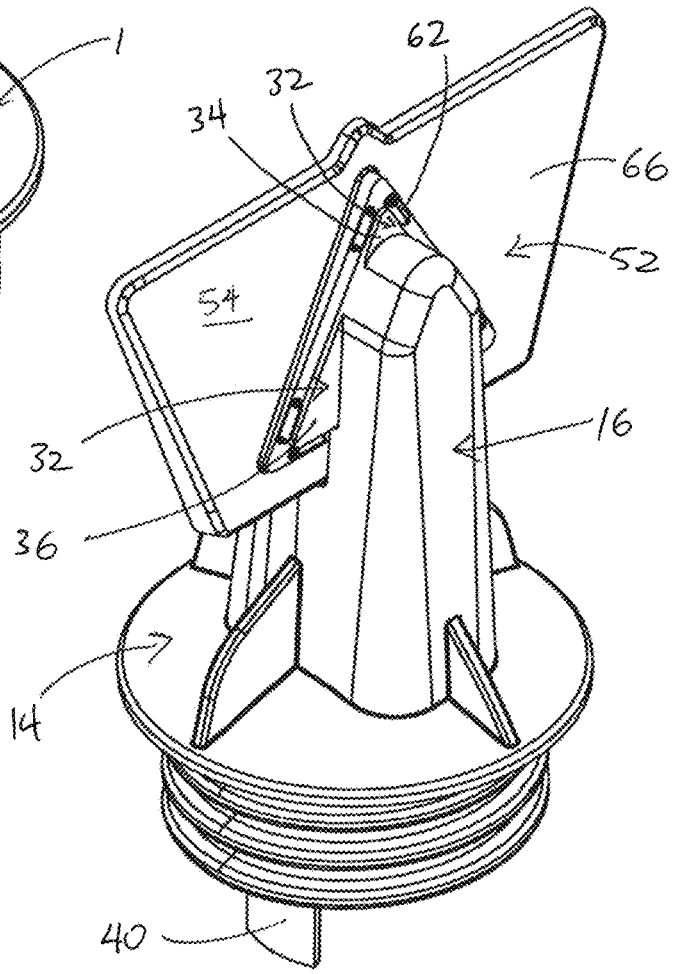
FIG. 13 is a side perspective view opposite to that shown in FIG. 8.

As best shown in FIGS. 10 and 12, outlet 24 is positioned proximate the outermost edge of blade perimeter 53. When applicator 10 is coupled to container 100, viscous material may travel through nozzle 12 and be extruded from outlet 24 adjacent the outer edge of the blade. This allows an extruded bead of material to be applied and molded into a desired shape by the adjacent portion of blade 50.

As noted above, protrusions 62 may be arranged in alternate configurations on raised platform 58. For example, rather than partially surrounding tabs 32 when blade 50 is received within slot 30, protrusions 62 may instead engage a depression or notch (not shown) situated within tabs 32 and/or support arm 16 to lock blade 50 in place. Other locking mechanisms may also be used to secure blade 50 within slot 30.

The shape of raised platform 58 does not necessarily have to correspond with the shape formed by tabs 32 and support arm 16. Raised platform 58 may take on a different shape so long as protrusions 62 are arranged in a manner that allows them to engage with tabs 32 and/or blade body 52 when blade 50 is received within slot 30.

After use, blade 50 may be removed from applicator 10. The user simply has to grip and pull the blade, forcing flanking tabs 36 on support arm 16 to resiliently flex, and to be released from between, protrusions 62 as blade 50 is pulled out of slot 30 and away from applicator 10.

Since each blade 50 has a similar raised platform 58, different blades may each be used with the same applicator 10, thereby providing the user with the option of using various different interchangeable and/or rotatable blades.

In an alternate embodiment, rather than having a raised platform, the thickness of blade 50 may be sized to be wider than slot 30 so that the respective internal walls of support arm 16 and nozzle 12 may frictionally engage with, and grip, blade 50 therebetween. The blade surface may itself be tapered or shaped to provide frictional engagement or "wedging" of blade 50 into slot 30. Raised lips or ridges may be included on the surface of the blade and/or walls 28*a*/28*b* to further help to secure the blade within slot 30.

It is to be understood that what has been described are the preferred embodiments of the invention. The scope of the claims should not be limited by the preferred embodiments set forth above, but should be given the broadest interpretation consistent with the description as a whole.

I claim:

1. An applicator for dispensing a viscous material from a container, the applicator comprising:

a nozzle portion for fluid communication with the container, the nozzle portion an outlet at a first end, an inlet at a base in proximity to an opposed second end, and a slot for releasably receiving a blade; and an attachment portion extending from the base the attachment portion configured to releasably engage the container to permit material within the container to flow under pressure through the nozzle and onto a surface, wherein the blade, when connected to the nozzle portion, is configured to contact the material as it exits the nozzle and assist in forming the material into a desired shape or configuration;

wherein the nozzle portion includes a nozzle defining a channel therein connecting the outlet at the first end and the inlet at the base;

wherein the nozzle portion includes a support arm spaced apart from the nozzle, the support arm and the nozzle collectively forming the slot therebetween for releasably receiving the blade;

wherein the blade comprises a first face having a raised platform dimensioned to releasably fit within the slot, the raised platform configured for engagement with the support aim;

wherein the support arm includes one or more tabs configured to engage the raised platform of the blade to releasably secure the blade within the slot;

wherein the raised platform includes one or more protrusions for engagement with the tabs of the support arm;

wherein the tabs are resiliently biased for snap-fit engagement with the one or more protrusions.

2. The applicator of claim 1, wherein the tabs include a leading tab at a distal end of the support arm and a pair of flanking tabs.

3. The applicator of claim 2, wherein the raised platform includes a ramp, the ramp facilitating the receipt of the leading tab onto the raised platform to thereby assist in the receipt of the blade within the slot.

4. The applicator of claim 1, wherein the blade comprises a blade body having a polygonal shape with corners having shapes different from one another.

5. The applicator of claim 1, wherein the blade is frictionally secured within the slot.

6. The applicator of claim 1, wherein the attachment portion is externally threaded and the threads are indexed to allow alignment of the blade with a label when the applicator is engaged with the collar.

7. The applicator of claim 1, wherein the attachment portion includes a leg extending away from the nozzle portion, the leg having a cutting edge orientated at an angle relative to a longitudinal axis of the attachment portion for cutting the container when the attachment portion is releasably engaged with the container.

8. The applicator of claim 7, wherein the cutting edge is orientated downwardly towards the container.

9. The applicator of claim 8, wherein the leg further has an edge opposite the cutting edge, the edge being orientated at an opposite angle relative to the angle of the cutting edge.

10. In combination, an applicator for fluidly engaging a casing, and a blade releasably securable to the applicator, the applicator having a nozzle portion with a slot, the blade comprising a body having a first face and an opposed second face, wherein the distance between the first face and the second face is dimensioned to permit the body to be releasably received within the slot;

the combination further comprising a raised platform on the first face for engagement within the slot;

wherein the nozzle portion includes a nozzle and a support arm which collectively form the slot therebetween, and wherein the raised platform includes one or more protrusions for engagement with the support arm;

wherein the raised platform has a perimeter, the raised platform further including a ramp at the perimeter.

11. The combination of claim 10, wherein the raised platform includes multiple protrusions for engagement with the support arm when the blade is received within the slot.

12. The combination of claim 11, wherein the body of the blade has a generally equilateral polygonal shape.

13. The combination of claim 12, wherein the shape of each corner of the blade body is different from one another.

* * * * *